US006129542A

United States Patent [19]

Gauba et al.

[11] Patent Number: 6,129,542

[45] Date of Patent: Oct. 10, 2000

[54] DUAL MODE PILOT BURNER

[75] Inventors: Gautam Gauba, Marlborough, Mass.; Charles Edward Benson, Windham, N.H.; Johannes H. J. Thijssen; Peter Joseph Loftus, both of Cambridge, Mass.; Roberto Ottavio Pellizzari, Groton, Mass.; Stephen Carl Licht, Cambridge, Mass.

[73] Assignee: Gas Research Institute, Chicago, Ill.

[21] Appl. No.: 09/316,414

[22] Filed: May 21, 1999

[51] Int. Cl.[7] ..... F23N 5/24; F23N 5/00; F24C 3/10

[52] U.S. Cl. ..... 431/12; 431/6; 431/25; 431/42; 431/75; 431/77; 431/191; 431/278

[58] Field of Search ..... 431/6, 12, 25, 431/42, 43, 75, 76, 77, 191, 283, 286, 278; 48/180

[56] References Cited

U.S. PATENT DOCUMENTS

| | | | |
|---|---|---|---|
| 1,355,998 | 10/1920 | Needham | 48/180 |
| 3,072,468 | 1/1963 | Stitzer | 431/12 |
| 3,295,585 | 1/1967 | Kovach, Jr. et al. | 431/76 |
| 3,376,098 | 4/1968 | Pryor | 431/12 |
| 3,405,999 | 10/1968 | Riehl | 431/42 |
| 3,619,095 | 11/1971 | Genbauffe | 431/42 |
| 4,087,229 | 5/1978 | Teichert et al. | 431/43 |
| 4,140,475 | 2/1979 | Wolfe | 431/42 |
| 4,315,729 | 2/1982 | Tanaka et al. | 431/75 |
| 4,447,204 | 5/1984 | Isenberg | 431/76 |
| 4,533,315 | 8/1985 | Nelson | 431/42 |
| 4,678,428 | 7/1987 | Tanaka et al. | 431/76 |
| 5,022,849 | 6/1991 | Yoshii et al. | 431/12 |
| 5,049,063 | 9/1991 | Kishida et al. | 431/78 |
| 5,453,002 | 9/1995 | Scott | 431/42 |

*Primary Examiner*—Ira S. Lazarus
*Assistant Examiner*—David Lee
*Attorney, Agent, or Firm*—Pauley Petersen Kinne & Fejer

[57] ABSTRACT

A dual mode pilot burner having a control flame mode of operation and a pilot flame mode of operation, which dual mode pilot burner is suitable for controlling the fuel/air ratio of a main burner when operating in the control flame mode of operation. The dual mode pilot burner includes a burner body having a control flame holder and a pilot flame holder disposed downstream of the control flame holder, a mixing chamber having a fuel gas inlet, an oxidant inlet, and a mixed gas outlet, which mixed gas outlet is in fluid communication with the control flame holder and a fuel gas control valve for controlling a fuel gas flow rate through the fuel gas inlet into the mixing chamber.

17 Claims, 4 Drawing Sheets

DUAL MODE PILOT BURNER

BACKGROUND OF THE INVENTION

1. Field of the Invention

This invention relates to a pilot burner for use in connection with gas-fired heating equipment such as boilers and furnaces. More particularly, this invention relates to a pilot burner for the main burners utilized in such heating equipment having the capability of not only igniting the main burners, but also having the capability of controlling the fuel/air ratio at which such main burners are fired. The pilot burner of this invention is particularly suitable for use in connection with closed loop control of burners, having the capability of functioning both as a control burner in the closed loop control system as well as an ignition pilot.

2. Description of Prior Art

Modulated gas-fired heating equipment burners operate over a wide turndown range and most of these burners use a mechanical linkage to control the air/fuel ratio. The amount of excess air varies with burner turndown and is typically maintained at 15–20% excess air for high fire operation and increases to about 40% excess air for lower firing rates. These excess air levels are higher than those required for efficient combustion due to safety considerations. For mechanical linkage based fuel/air ratio control, there is typically a variation of plus or minus 1% in flue gas oxygen due to factors such as variation in air and gas properties as well as mechanical linkage hysteresis. Current closed loop air/fuel ratio control systems, based on $O_2$ and CO measurements, are expensive and can only be justified for higher design firing rate burners.

Accordingly, there is a need for closed loop fuel/air ratio control systems which, in addition to being advantageously suitable for use at high firing rates, is also advantageously suitable for use at lower firing rates. There is also a need for closed loop fuel/air ratio control systems which eliminate the need for mechanical linkage fuel/air ratio control.

Multiple burner heating equipment applications present significant fuel/air ratio control problems because there is currently no easy way to control the fuel/air ratio of each burner. Thus, there is a need for a closed loop fuel/air ratio control system which enables each burner of a multiple burner application to be individually controlled.

Current closed loop fuel/air ratio control systems employ options such as $O_2$ and CO analyzers for fuel/air ratio control. Such implementation generally tends to be relatively expensive. Thus, there is also a need for fuel/air ratio controllers for closed loop fuel/air ratio control systems which are lower in cost than such currently employed options.

SUMMARY OF THE INVENTION

Accordingly, it is one object of this invention to provide a closed loop fuel/air ratio control system which is suitable for use over the full design firing rate of gas-fired heating equipment burners.

It is another object of this invention to provide a closed loop fuel/air ratio control system for gas-fired heating equipment burners which eliminates the need for mechanical linkages.

It is yet another object of this invention to provide a lower cost closed loop air/fuel ratio control system for gas-fired heating equipment burners which can replace more expensive options currently employed.

These and other objects of this invention are addressed by a pre-mixed pilot burner for low-cost closed loop air/fuel ratio control in gas-fired heating equipment burners comprising a burner body having a control flame holder, a mixing chamber having a fuel gas inlet, an oxidant inlet, and a mixed gas outlet, which mixed gas outlet is in fluid communication with the control flame holder, a control flame igniter, and control means for controlling the fuel gas flow rate through the fuel gas inlet into the mixing chamber. In accordance with one particularly preferred embodiment which provides dual-mode operability, the burner body further comprises a pilot flame holder disposed downstream of the control flame holder. This dual-mode pilot burner is capable of operating both as a control burner and as an ignition pilot. Furthermore, this dual-mode pilot burner can be designed to be a direct plug-in replacement for existing ignition pilot burner assemblies. During the control burner mode of operation, a control flame is anchored at the control flame holder while during ignition pilot mode, a pilot flame anchors at the pilot flame holder.

It is known that hydrocarbon gas flames conduct electricity due to charged species (ions) formed by the chemical reaction of the fuel and air. The concentration of these ions is a function of the temperature of the flame, which, in turn, is a function of the ratio of fuel and air supplied to the flame, with a peak in ion concentration occurring at or near the stoichiometric fuel/air ratio. When an electrical potential is established across the flame, the ions form a conductive path, and current flows. The higher the ion concentration, the more current will flow. This invention utilizes the relationship between ion concentration and fuel/air ratio of the combustible mixture supplied to a burner to derive control parameters which are then used to adjust and maintain a desired fuel/air ratio. A suitable device for measuring the current flow due to ionization in a flame is a flame ionization sensor. For a more detailed description of the flame ionization process, see U.S. patent application Ser. No. 08/747,777 which is incorporated herein by reference. In accordance with one preferred embodiment, the dual-mode pilot burner of this invention further comprises a flame ionization sensor positioned to measure the current flow resulting from ionization in the control flame.

The objects of this invention are further addressed by a modulated burner system comprising a primary burner, a primary fuel gas supply and a primary oxidant gas supply connected to the primary burner, a pilot burner comprising a burner body having a control flame holder, a mixing chamber having a fuel gas inlet, an oxidant inlet, and a mixed gas outlet, which mixed gas outlet is in fluid communication with the control flame holder, a control flame igniter, and control means for controlling the fuel/air ratio of the combustible mixture to the primary burner. The control means comprises a flame ionization sensor positioned to measure the current flow resulting from ionization in a control flame produced by said dual mode pilot burner when operating in said control mode, a controller, and at least one modulating primary fuel gas supply valve for modulating fuel gas supply to the primary burner. The controller is operatively connected to the flame ionization sensor and the modulating primary fuel gas supply valve. In accordance with one preferred embodiment, the burner body further comprises a pilot flame holder disposed downstream of the control flame holder.

The objects of this invention are further addressed in a system for modulating a burner as described above by a method for controlling said primary burner fuel/air ratio comprising the steps of igniting the primary burner with a dual mode pilot burner having a control flame mode of operation and a pilot flame mode of operation, which dual mode pilot burner is operating in the pilot flame mode, reducing an amount of pilot burner fuel gas to the dual mode pilot burner resulting in switching the dual mode pilot burner to the control flame mode of operation, which control flame mode of operation produces a control flame in the dual mode pilot burner having a pilot burner fuel gas input proportional to the fuel input to the primary burner. The fuel/air ratio of the control flame is measured and compared to a preset value. The primary burner fuel gas input is then adjusted until the control flame fuel/air ratio is proximate the preset value. It will be apparent to those skilled in the art that each mode of operation of the dual-mode pilot burner in accordance with one embodiment of this invention is independent of the other. Thus, for burners which have their own ignition systems, only the control flame mode of operation is necessary. In those instances, there may be no pilot flame holder.

BRIEF DESCRIPTION OF THE DRAWINGS

These and other objects and features of this invention will be better understood from the following detailed description taken in conjunction with the drawings wherein.

DETAILED DESCRIPTION OF PREFERRED EMBODIMENTS

Although this invention will be described in terms of its application to boiler burners, it will be apparent that it may also be applied to other types of burners. There is no intent by this description to limit the scope of this invention in any way to the specific descriptions and applications set forth herein.

Figure 1:
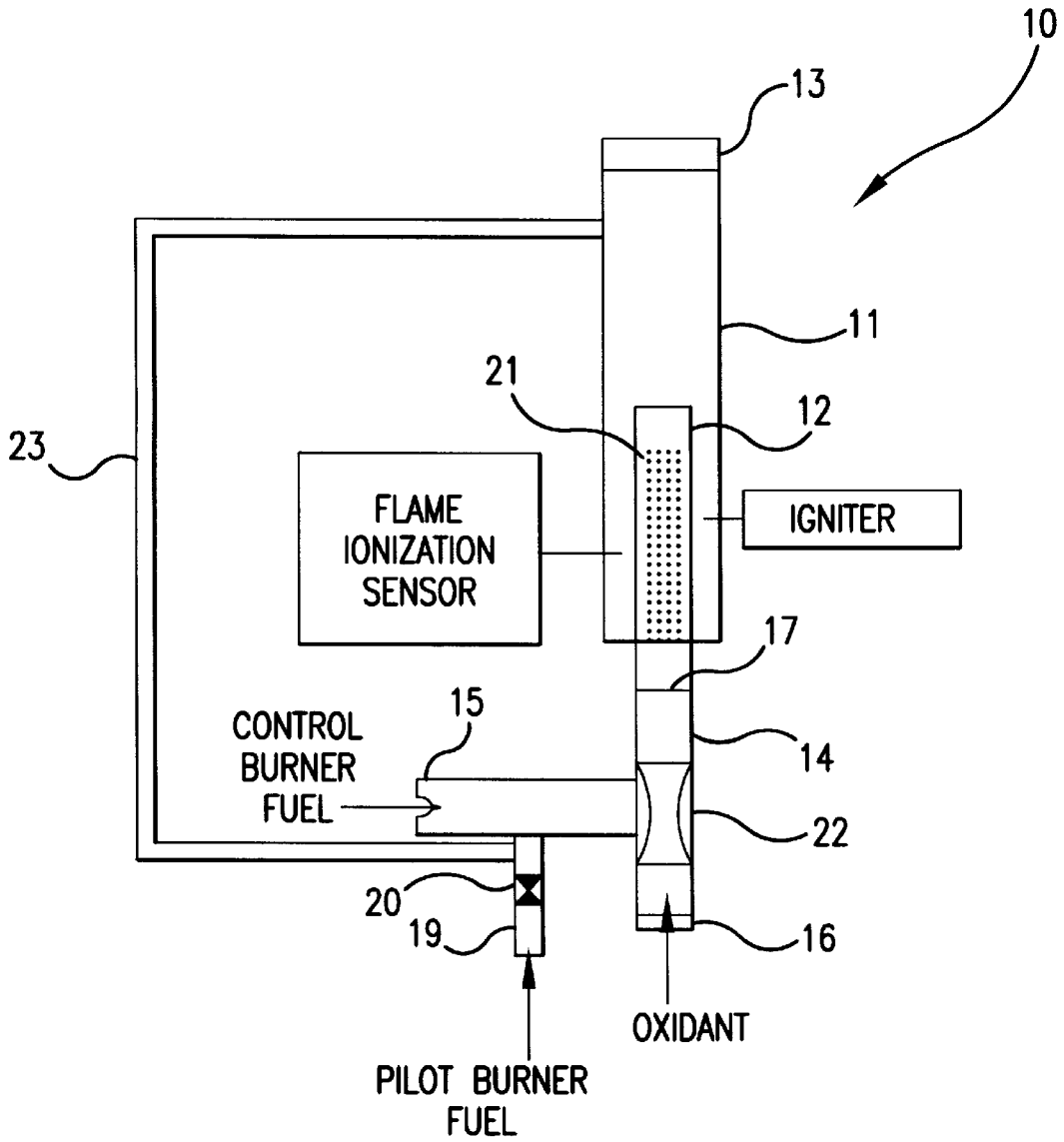
FIG. 1 is a schematic diagram of a dual-mode pilot burner for use in a modulated burner system in accordance with one embodiment of this invention.
Figure 1A:
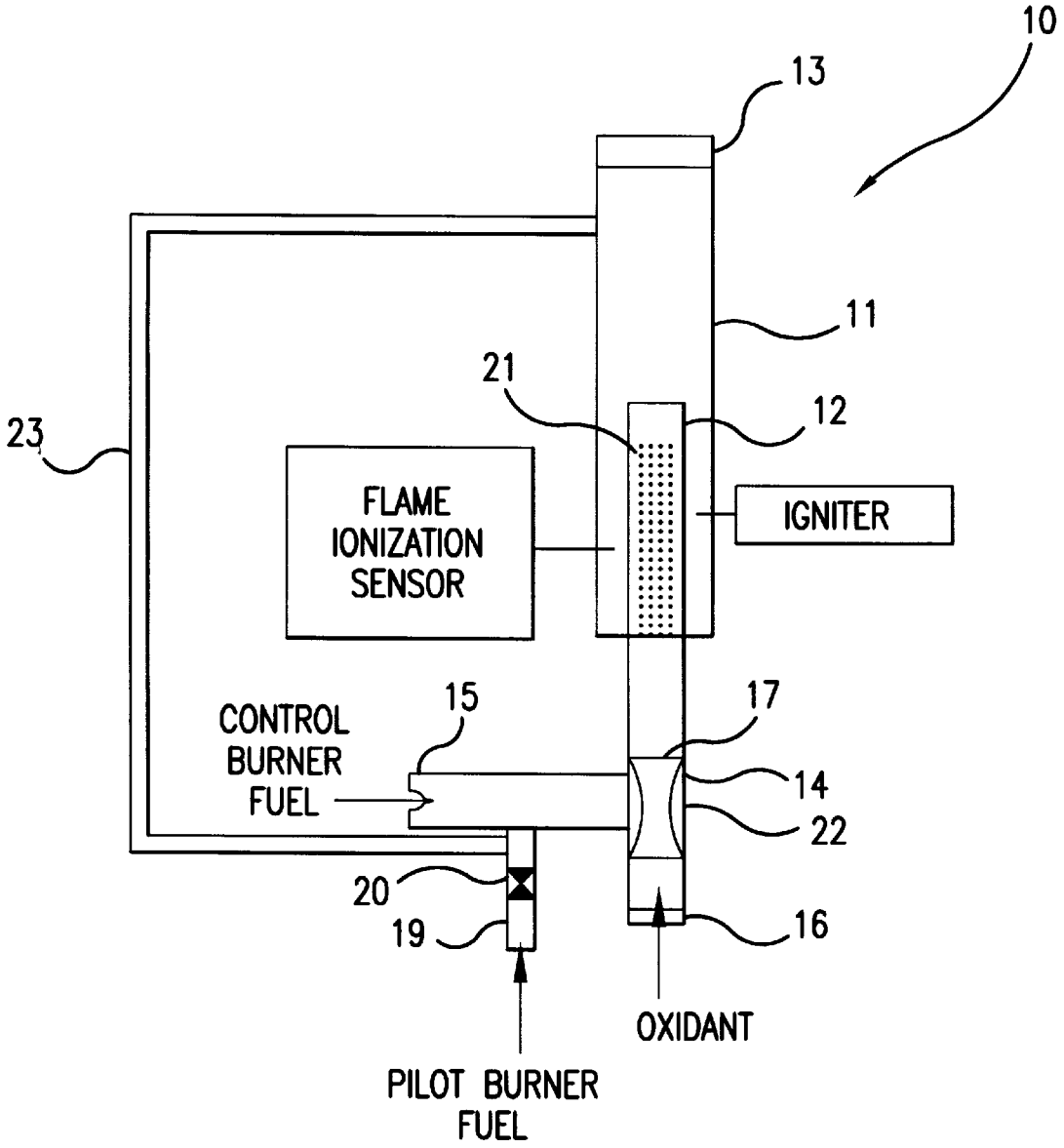
FIG. 1A is a schematic diagram of a dual-mode pilot burner for use in a modulated burner system in accordance with another embodiment of this invention.

FIG. 1 is a schematic diagram of a dual mode pilot burner in accordance with one embodiment of this invention. Dual mode pilot burner 10 comprises burner body 11 having two flame holding regions in the form of control flame holder 12 and pilot flame holder 13 disposed downstream of control flame holder 12. In accordance with one preferred embodiment of this invention, control flame holder 12 comprises a perforated burner face disposed within burner body 11. Other control flame holder configurations besides a perforated burner face may be employed and are considered to be within the scope of this invention. In the control burner mode of operation, a control flame is anchored at perforated burner face 21 and pilot burner fuel gas and air flow rates are proportional or otherwise functionally related to the fuel gas and air flow rates to the main burner controlled by the dual mode pilot burner. Dual mode pilot burner 10 further comprises mixing chamber 14 in which the gas supply entering dual mode pilot burner 10 through control burner gas flow input 15 and oxidant entering dual mode pilot burner 10 through oxidant inlet 16 are mixed. The fuel/air mixture is provided to control flame holder 12 through mixed gas outlet 17 of mixing chamber 14. Dual mode pilot burner 10 further comprises pilot fuel gas inlet 19, the flow of which is controlled by on/off pilot gas flow valve 20. During the control burner mode, on/off pilot gas flow valve 20 is closed, thereby preventing the flow of pilot burner fuel gas into dual mode pilot burner 10.

During the pilot flame mode of operation of dual mode pilot burner 10, pilot burner fuel gas is supplied to dual mode pilot burner 10 by opening on/off pilot gas flow valve 20, thereby producing a fuel-rich mixture in mixing chamber 14 that does not burn at control flame holder perforated face 21 of control flame holder 12. Rather, the control flame at control flame holder 12 lifts off from control flame holder perforated face 21 and anchors at the exit of burner body 11, pilot flame holder 13, forming a partially pre-mixed flame that can be used to ignite a primary (main) burner. The ignition pilot flame length can be varied by adjusting the pilot fuel/air ratio and fuel flow rate. The burner body exit is designed to provide a flame holding surface for a range of ignition pilot firing rates. The burner body exit also provides a means of entraining more air to provide a combustible mixture at higher firing rates. This provides the flexibility needed for adapting the design to a wide range of burners. In accordance with an alternative embodiment, rather than introducing the additional fuel gas required for operation of the dual mode pilot burner in the pilot mode of operation into mixing chamber 14, the fuel gas may be introduced into burner body 11 between control flame holder 12 and pilot flame holder 13, as indicated by conduit 23 shown in FIG. 1.

As previously stated, control flame holder 12 preferably comprises a multi-ported flame holder in the form of a perforated sheet metal with clusters of holes used as the burner face area. In accordance with one preferred embodiment of this invention, a venturi 22 is disposed between control burner gas flow input 15 and mixing chamber 14. The venturi enables the control flame fuel gas to be injected into mixing chamber 14 against a back pressure which is the same as the furnace back pressure. This, in turn, results in better tracking between the fuel/air ratio of the control flame and the fuel/air ratio of the primary burner. Alternatively, the venturi may function as the mixing chamber.

Figure 2:
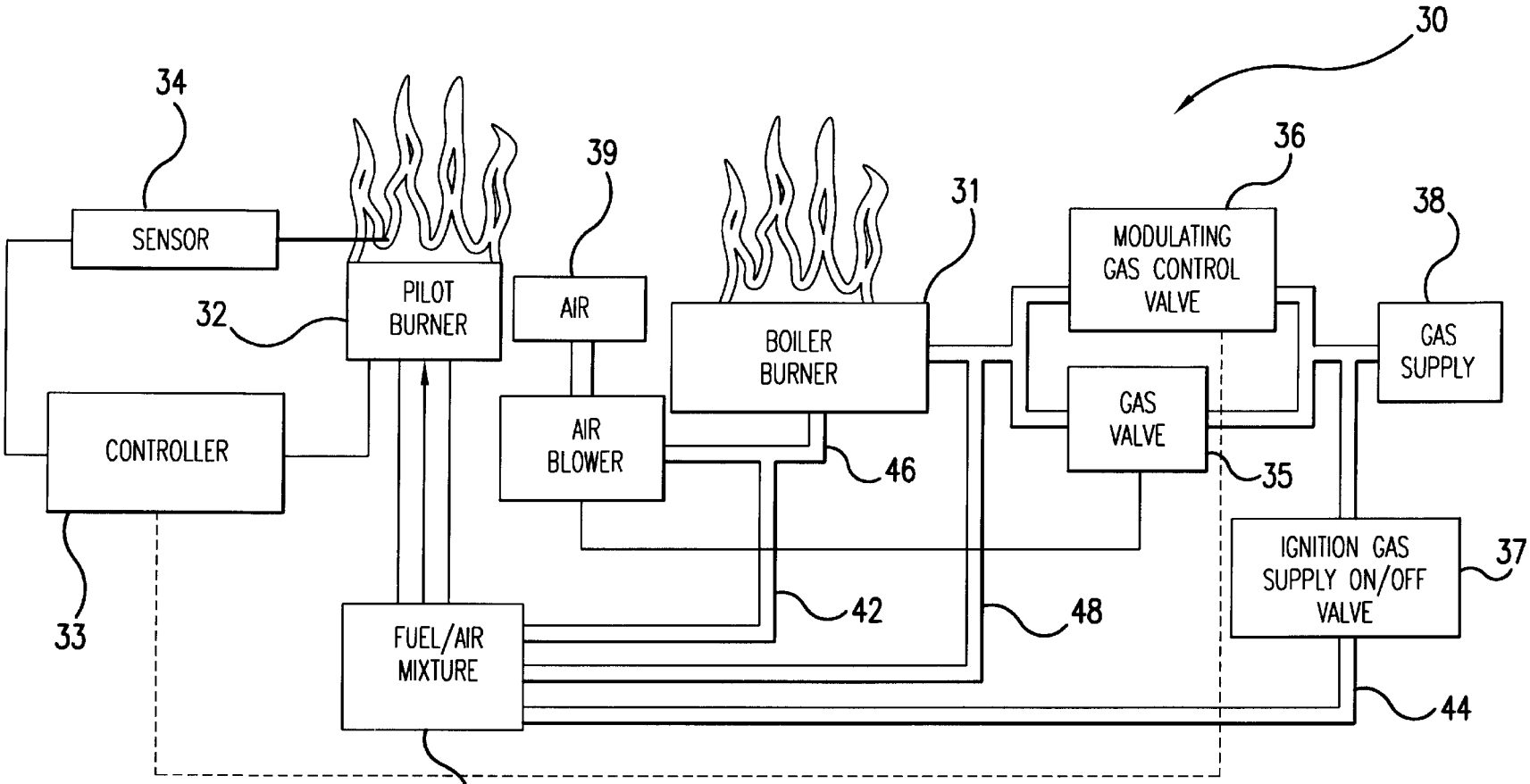
FIG. 2 is a schematic diagram of a closed loop air/fuel ratio control system for burners in accordance with one embodiment of this invention.

FIG. 2 shows a closed loop fuel/air ratio control system for pre-packaged boiler burners using a dual mode pilot burner in accordance with this invention. When operating in a control flame mode, dual mode pilot burner 32 receives fuel gas through line 48 which draws fuel gas in proportion to the fuel gas input to boiler burner 31 from the fuel supply to the boiler burner 31. Air is provided through line 46 from the air supply 39 to boiler burner 31 and through line 42 to mixing chamber 40. As in the case of the air, fuel gas is withdrawn from line 48. Flame ionization sensor 34 which is operatively connected to controller 33 measures the current flow generated by ionization of chemical species within the control flame attached to the control flame holder of dual mode pilot burner 32. When the time comes to ignite boiler burner 31, ignition fuel gas supply on/off valve 37 is opened, enabling fuel gas from gas supply 38 to pass through line 44 into mixture chamber 40. As a result of the fuel-rich mixture in mixing chamber 40, the control flame is lifted off the control flame holder and attaches to the pilot flame holder which then ignites boiler burner 31.

Controller 33 is operatively connected to flame ionization sensor 34 and modulating fuel gas control valve 36 so as to ensure proper maintenance of the fuel/air ratio to boiler burner 31. In operation, when dual mode pilot burner 32 is operating in a control flame mode of operation, flame ionization sensor 34 measures the current generated by the control flame and transmits the resulting measurements to controller 33 in which the measurements are converted by application of a mathematical algorithm to the fuel/air ratio of the combustible mixture supplied to the control flame holder. As previously stated, the amount of fuel gas and combustion air supplied to dual mode pilot burner 32 is functionally related to the amount of fuel gas and combustion air supplied to boiler burner 31. Consequently, there is a direct correspondence between the fuel/air ratio of the combustible mixture supplied to dual mode pilot burner 32 and the fuel/air ratio of the combustible mixture supplied to boiler burner 31. As a result, whenever the flame ionization sensor measures a current which corresponds to a fuel/air ratio which is significantly different from a preset value, as determined by controller 33, controller 33 adjusts modulating fuel gas control valve 36 until the flame ionization sensor measures a current which corresponds to a fuel/air ratio substantially equivalent to said preset value. Because of the relatively close tracking of the fuel/air ratio of the combustible mixture supplied to dual mode pilot burner 32 and the fuel/air ratio of the combustible mixture supplied to boiler burner 31, adjustment of the fuel/air ratio of the combustible mixture supplied to dual mode pilot burner 32 results in a corresponding adjustment to the fuel/air ratio of the combustible mixture supplied to boiler burner 31.

A further consideration for the modulated burner system of this invention is the ability of the system to track the fuel/air ratio of the combustible mixture supplied to boiler burner 31 over a wide turndown ratio. As previously indicated, conventional modulated burners operate over a wide turndown range whereby the excess air required at high firing rates is typically maintained at about 15% to about 20% and, at lower firing rates, the excess air increases to about 40%.

Figure 3:
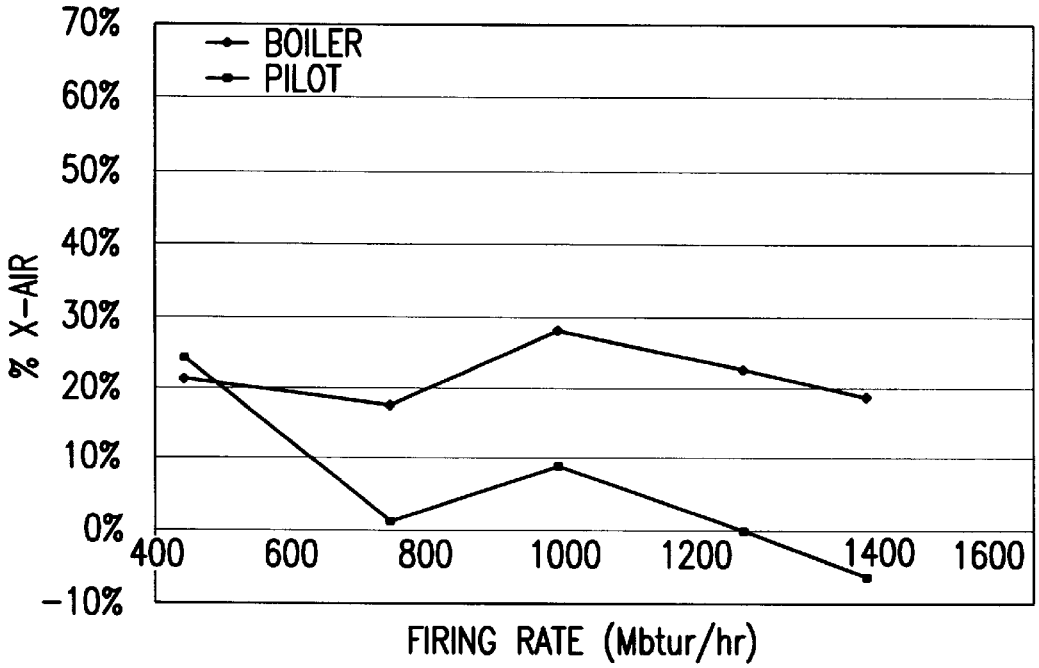
FIG. 3 is a diagram showing the tracking of the control flame fuel/air ratio relative to the primary burner fuel/air ratio obtained using the method and a dual mode pilot burner in accordance with one embodiment of this invention.

FIG. 3 is a diagrammatic representation of data collected from a boiler system using a closed loop fuel/air ratio control system in accordance with this invention. Two curves are shown which correspond to the fuel/air ratios of the combustible mixtures supplied to dual mode pilot burner 32 and boiler burner 31 for a given turndown of boiler burner 31. If the fuel/air ratio of the combustible mixture supplied to dual mode pilot burner 32 corresponds to the fuel/air ratio of the combustible mixture supplied to boiler burner 31, the two curves would be parallel to each other. As shown, for the embodiment of the dual mode pilot burner of this invention without a venturi disposed between said pilot burner fuel gas inlet and said mixing chamber, the two curves track well with respect to each other, particularly with respect to a turndown of about 2. However, below a turndown of about 2, the two curves do not track quite as well. However, we have found that using a pilot burner employing a venturi in accordance with one embodiment of this invention results in significantly better tracking of the two curves, even at turndowns of less than about 2.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A dual-mode pilot burner comprising:

a burner body comprising a control flame holder and a pilot flame holder disposed downstream of said control flame holder;

a mixing chamber disposed upstream of said control flame holder and having a fuel gas inlet, an oxidant inlet, and a mixed gas outlet, said mixed gas outlet in fluid communication with said control flame holder; and control means for controlling a fuel gas flow rate through said fuel gas inlet into said mixing chamber, said control means comprising a fuel gas conduit in fluid communication with said fuel gas inlet and having a control burner fuel gas inlet, a pilot fuel gas inlet, and pilot fuel gas control means for controlling a pilot fuel gas flow rate into said fuel gas conduit, and primary burner control means for controlling a fuel/air ratio of a combustible mixture to a primary burner.

2. A burner in accordance with claim 1, wherein said pilot fuel gas control means comprises a pilot fuel gas conduit in fluid communication with said pilot fuel gas inlet and an on/off pilot control valve connected to said pilot fuel gas conduit, said on/off pilot control valve controlling said pilot fuel gas flow rate.

3. A burner in accordance with claim 1, wherein said control flame holder is a multi-ported flame holder.

4. A burner in accordance with claim 1, wherein said primary burner control means comprises a flame ionization sensor operably connected to a burner controller, said flame ionization sensor positioned to measure a control flame fuel/air ratio of fuel and air to a control flame attached to said control flame holder whereby said burner controller adjusts said fuel/air ratio of said combustible mixture to said primary burner.

5. A burner in accordance with claim 1, wherein a venturi is disposed between said oxidant inlet and said mixing chamber and is in fluid communication with said oxidant inlet and mixing chamber.

6. A burner in accordance with claim 1, wherein said mixing chamber is a venturi.

7. A modulated burner system comprising:

a primary burner;

a primary fuel gas supply and a primary oxidant supply in fluid communication with said primary burner;

a dual mode pilot burner having a control mode of operation and a pilot mode of operation; and a primary burner control means for controlling a primary burner fuel/air ratio based upon a pilot burner fuel/air ratio during said control mode of operation.

8. A system in accordance with claim 7, wherein said primary burner control means comprises a flame ionization sensor positioned to measure a control flame fuel/air ratio of a control flame attached to said control flame holder.

9. A system in accordance with claim 8, wherein a signal output of said flame ionization sensor is operably connected to a signal input of a controller, and said controller is operably connected to a modulating fuel gas control valve in fluid communication with said primary burner and controls said modulating gas control valve in response to a signal generated by said flame ionization sensor.

10. A system in accordance with claim 7, wherein said pilot burner control means comprises an ignition fuel gas supply on/off valve in fluid communication with said fuel gas supply and at least one of said burner body and said mixing chamber.

11. In a system for modulating a burner comprising a primary burner, a primary fuel gas supply and a primary oxidant supply in fluid communication with said primary burner, and primary burner control means for controlling a primary burner fuel/air ratio, a method for controlling said primary burner fuel/air ratio comprising the steps of:

igniting said primary burner with a dual mode pilot burner having a control flame mode of operation and a pilot flame mode of operation and operating in said pilot flame mode of operation;

reducing an amount of pilot burner fuel gas to said dual mode pilot burner resulting in switching said dual mode pilot burner to said control flame mode of operation, said control flame mode of operation producing a control flame in said dual mode pilot burner having a pilot burner fuel gas input functionally related to a primary burner fuel input;

measuring a control flame fuel/air ratio and comparing said measured control flame fuel/air ratio to a preset value; and adjusting said primary burner fuel gas input until said control flame fuel/air ratio is proximate said preset value.

12. A method in accordance with claim 11, wherein said control flame fuel/air ratio is measured using a flame ionization sensor which generates a signal, said signal is input to a controller operably in communication with said flame ionization sensor, and said controller modulates a modulating gas control valve in fluid communication with a gas supply and said primary burner.

13. A control pilot burner for controlling a fuel/air ratio of a primary burner comprising:

a burner body comprising a control flame holder in the burner body;

a pilot flame holder disposed downstream of said control flame holder;

a mixing chamber disposed upstream of said control flame holder and having a fuel gas inlet, an oxidant inlet, and a mixed gas outlet, said mixed gas outlet in fluid communication with said control flame holder; and control means for controlling a fuel gas flow rate through said fuel gas inlet into said mixing chamber, said control means comprising a flame ionization sensor operably connected to a burner controller and positioned to measure a fuel/air ratio of fuel and air to a control flame attached to said control flame holder, whereby a signal generated by said flame ionization sensor modulates gas flow to a primary burner.

14. A control pilot burner in accordance with claim 13, wherein said control means comprises a fuel gas conduit in fluid communication with said fuel gas inlet and having a control burner fuel gas inlet and a pilot fuel gas inlet, and pilot fuel gas control means for controlling a pilot fuel gas flow rate into said fuel gas conduit.

15. A control pilot burner in accordance with claim 14, wherein said pilot fuel gas control means comprises a pilot fuel gas conduit in fluid communication with said pilot fuel gas inlet and an on/off pilot control valve connected to said pilot fuel gas conduit, said on/off pilot control valve controlling said pilot fuel gas flow rate.

16. A burner in accordance with claim 13, wherein said control flame holder is a multi-ported flame holder.

17. A burner in accordance with claim 14, wherein a venturi is disposed between said fuel gas conduit and said fuel gas inlet and is in fluid communication with said fuel gas conduit and said fuel gas inlet.

* * * * *

UNITED STATES PATENT AND TRADEMARK OFFICE

CERTIFICATE OF CORRECTION

PATENT NO. : 6,129,542
DATED : 10 October 2000
INVENTOR(S) : Gautam Gauba et al.

It is certified that error appears in the above-identified patent and that said Letters Patent is hereby corrected as shown below:

In Column 6, line 41, after "operation" and before ";" insert:

--comprising a burner body comprising a control flame holder in the burner body, a pilot flame holder downstream of said control flame holder, a mixing chamber having a fuel gas inlet, an oxidant inlet and a mixed gas outlet, said mixed gas outlet in fluid communication with said control flame holder, and pilot burner control means for controlling a pilot burner fuel gas flow rate through said fuel gas inlet--

Signed and Sealed this

Eighth Day of May, 2001

*Attest:*

Nicholas P. Godici

NICHOLAS P. GODICI

*Attesting Officer*

*Acting Director of the United States Patent and Trademark Office*